United States Patent [19]

Stumpff et al.

[11] Patent Number: 4,740,175

[45] Date of Patent: Apr. 26, 1988

[54] ELECTRICAL RECEPTACLE APPARATUS

[76] Inventors: Phillip W. Stumpff, P.O. Box 802, Madill, Okla. 73446; Richard D. Taylor, P.O. Box 684, Kingston, Okla. 73439

[21] Appl. No.: 939,188

[22] Filed: Dec. 8, 1986

[51] Int. Cl.[4] ..... H01R 4/24

[52] U.S. Cl. ..... 439/441

[58] Field of Search ..... 339/95 D

[56] References Cited

U.S. PATENT DOCUMENTS

| | | | |
|---|---|---|---|
| Re. 29,513 | 6/1978 | Johnson | 339/112 R |
| 2,671,204 | 3/1954 | Hubbell | 339/59 |
| 2,705,785 | 4/1955 | Benander | 339/95 D |
| 2,725,544 | 11/1955 | Strange | 339/95 |
| 2,738,482 | 3/1956 | Benander | 339/95 D |
| 2,743,423 | 4/1956 | Parks | 339/21 |
| 2,753,538 | 7/1956 | Carlson | 339/95 D |
| 2,873,433 | 2/1959 | Despard | 339/95 D |
| 2,875,424 | 2/1959 | Hubbell | 339/95 D |
| 2,890,436 | 6/1959 | Bentley | 339/258 |
| 3,001,168 | 9/1961 | Smith | 339/164 |
| 3,097,906 | 7/1963 | Shannon | 339/253 |
| 3,323,099 | 5/1967 | Spera | 339/192 |
| 3,324,447 | 6/1967 | Pistey | 339/95 |
| 3,339,170 | 8/1967 | Martin | 339/31 |
| 3,393,397 | 7/1968 | Manichl | 339/95 |
| 3,451,037 | 6/1969 | Herrli | 339/192 |
| 3,569,911 | 3/1971 | Bogdanowicz | 339/95 |
| 3,585,570 | 6/1971 | Jans | 339/95 |
| 3,717,840 | 2/1973 | Vaughan et al. | 339/198 R |
| 3,828,113 | 8/1974 | Bourne | 174/55 |
| 3,863,037 | 1/1975 | Schindler et al. | 174/58 |
| 3,885,852 | 5/1975 | Grove | 339/95 D |
| 3,916,149 | 10/1975 | Skinner | 219/335 |
| 3,922,478 | 11/1975 | Perkey | 174/53 |
| 3,936,126 | 2/1976 | Miller | 339/95 D |
| 3,945,711 | 3/1976 | Hohorst et al. | 339/95 D |
| 4,012,100 | 3/1977 | Viscosi | 339/95 D |
| 4,106,835 | 8/1978 | Kimm | 339/95 D |
| 4,165,443 | 8/1979 | Figart et al. | 174/53 |
| 4,166,934 | 9/1979 | Marrero | 200/51 R |
| 4,210,772 | 7/1980 | Magana et al. | 174/59 |
| 4,295,018 | 10/1981 | Borrelli | 200/51.09 |
| 4,336,418 | 6/1982 | Hoag | 174/53 |
| 4,420,215 | 12/1983 | Tengler | 339/176 R |

*Primary Examiner*—Joseph H. McGlynn

*Attorney, Agent, or Firm*—Laney, Dougherty, Hessin & Beavers

[57] ABSTRACT

An electrical receptacle apparatus adapted for plug-in wiring. The receptacle apparatus has an insulating housing made of a cover and a body. The body defines a plurality of terminal receiving cavities therein. A terminal portion of a plurality of electrical contact strips is disposed in each of the terminal receiving cavities. The terminal portions are adapted for receiving and grippingly engaging an electrical wire inserted through an opening in the housing. A cantilevered strip extends from each of the terminal portions in a longitudinal direction through the body, and each cantilevered strip has at least one set of first and second plug receiving and gripping fingers. The housing has a plurality of plug receiving openings therein in registry with the sets of plug receiving fingers. The electrical contact strips include a power contact strip, a common contact strip, and a ground or neutral contact strip disposed between the power and common contact strips. The plug receiving fingers on each strip are adapted to receive and grippingly engage the appropriate prongs on an electrical plug. The cover of the housing includes a flange extending therefrom which is adapted for mounting to a wall member. The cover of the housing further includes walls thereon separating, guiding and supporting the cantilevered strips of the electrical contact strips.

38 Claims, 3 Drawing Sheets

ELECTRICAL RECEPTACLE APPARATUS

BACKGROUND OF THE INVENTION

1. Field of the Invention

This invention relates to a plug-in type electrical recepticle apparatus for use in constructing the wiring system of a house or other building, and more particularly, to a receptacle apparatus having a plurality of cantilevered electrical contact strips with plug receiving means thereon.

2. Description of the Prior Art

When a new building is being wired or an older building is being rewired, considerable time must be spent in making electrical connections within and between conventional junction, switch and receptacle boxes, and considerable time must be spent in mounting such boxes. Accordingly, a need exists for an electrical receptacle box with which various electrical conductors may be quickly electrically connected in order to provide the electrical circuitry, and which may be quickly mounted from joists and studs.

The prior art includes wiring systems having plug-in type connections, such as seen in U.S. Pat. No. 4,165,443 to Figart et al.

Also, the prior art has included electrical boxes having offset flanges for the mounting of the box on studs on the face of the box extending from the stud at a distance equal to the thickness of the wallboard to be used with the device, as seen in U.S. Pat. No. 3,863,037 to Schindler et al.

Other examples of various forms of electrical connection apparatus, including plug-in connectors, and in some instances some of the other general structural operational features of the present invention, may include U.S. Pat. Nos. 3,393,397; 3,451,037; 3,569,911; 3,585,570; 3,717,840; 3,828,113; 3,885,852; 3,945,711; 4,012,100; and 4,106,835. Specifically, electrical receptacles are shown in U.S. Pat. Nos. 2,738,482; 3,339,170; 4,166,934; and 4,336,418.

In spite of the numerous attempts which have been made to develop a practical alternative to conventional junction, switch and receptacle boxes, some of which attempts are shown in the above-cited references, none of these attempts has succeeded in providing a system which has found widespread acceptance in the marketplace. There is still the need for much improvement in plug-in type electrical boxes, and the present invention provides an electrical receptacle apparatus addressing such needs.

A typical electrical receptacle, such as manufactured by General Electric, has a two-piece insulating housing with a pair of electrically conducting plug-receiving portions and a ground plug-receiving strip. A fourth electrically conducting piece extends between the housing portions and is in electrical communication with the ground contact strip and further provides mounting flanges for attaching the receptacle to a typical receptacle box. This mounting strip also includes a screw terminal for attachment of a ground wire. The two plug-receiving portions include screw terminals for attachment of power and common wires thereto, respectively. While this apparatus is in widespread use, and thus economically manufactured in large quantities, there is a need for a simplified electrical receptacle which reduces the number of parts, as well as providing plug-in wiring as discussed above. The present invention, utilizing a two-piece housing which also acts as the receptacle box and includes only three contact strips therein, greatly reduces the number of parts required, as well as providing a plug-in rather than screw terminal system. The improvements of the present invention also provide an electrical receptacle apparatus which includes conventionally manufactured parts and one which is quickly assembled.

SUMMARY OF THE INVENTION

The electrical receptacle apparatus of the present invention comprises an insulating housing defining a wire receiving housing opening and a plug receiving opening therein and an electrical contact strip disposed in the housing. The electrical contact strip comprises wire receiving means for receiving an electrical wire, a cantilevered strip extending from the wire receiving means, and plug receiving means on the cantilevered strip for receiving an electrical plug portion, such as a prong. Supporting means are provided for supporting the cantilevered strip at least when the electrical plug portion is received by the plug receiving means.

The wire engaging means comprises a web portion having a wire receiving web opening disposed therethrough and first and second leg portions extending from the web portions. The leg portions are arranged for engagingly receiving the wire therebetween. The web portion is an elongated web portion and has an extended portion from which the cantilevered strip extends. The web opening is one of a plurality of aligned web openings disposed through the elongated web portion. Each of the leg portions is an elongated leg portion, and at least one of the first and second leg portions is split transversely to a length thereof between adjacent web openings, so that the leg portions can engagingly receive different sizes of wire in the adjacent web openings.

In an alternate embodiment, shoulder means are provided adjacent the wire receiving means for engaging the wire and providing increased electrical contact therewith. Preferably, the shoulder means is characterized by a shoulder stamped from one of the first and second leg portions and extending substantially perpendicular to the web portion.

The housing defines at least one socket with a plurality of wire receiving housing openings therein, and the housing openings are aligned with corresponding wire receiving web openings.

At least a part of one of the first and second leg portions is arcuate in cross section with a convex side thereof facing the other of the leg portions. The other leg portion has a planar part adjacent and offset towards the convex side of the one leg portion, so that the wires are engagingly gripped between the convex side of the arcuate part of the one leg portion and the planar part of the other leg portion with at least one leg portion resiliently biased against the wire.

The wire receiving means further comprises retaining means for engaging the wire when the wire is inserted through the wire receiving web opening and for resisting withdrawal of the wire from the opening. Preferably, the retaining means is a resilient tab punched from the web portion. The tab has a fixed end integrally attached to the web portion and further has a free end extending from the web portion away from the housing. The free end of the tab has a notch therein for engaging the wire.

The electrical contact strip or member disposed in the housing is preferably one of a plurality of such electrical conducting members comprising an electrical conducting power member, an electrical conducting common member, and an electrical conducting ground or neutral member.

The plug receiving means comprises a set of first and second spaced finger portions extending from the centilevered strip of each electrical contact strip. The finger portions are adapted for engagingly receiving a prong of an electrical plug therebetween. The housing defines a plurality of plug receiving openings therein, and each plug receiving opening is in registry with a set of such first and second finger portions. Preferably, the set of first and second finger portions is one of a plurality of such sets longitudinally spaced along the cantilevered strip. The first and second finger portions are adapted for engagingly receiving the corresponding prongs on a two- or three-prong electrical plug, including polarized plugs.

The housing further comprises mounting means for mounting to a wall member, and the mounting means is characterized by a flange extending from a cover of the housing.

An important object of the present invention is to provide an electrical receptacle apparatus with a plug-in wiring system and which is easily assembled and installed.

Another object of the invention is to provide an electrical receptacle apparatus having an electrical contact strip therein in which the contact strip includes wire receiving means and a cantilevered strip with plug receiving means thereon.

Still another object of the present invention is to provide an electrical receptacle apparatus adaptable for receiving standard two- and three-prong electrical plugs.

Other objects and advantages of the invention will become apparent to those skilled in the art as the following detailed description of the preferred embodiment is read in conjunction with the drawings which illustrate such preferred embodiment.

DESCRIPTION OF THE PREFERRED EMBODIMENT

Figure 1:
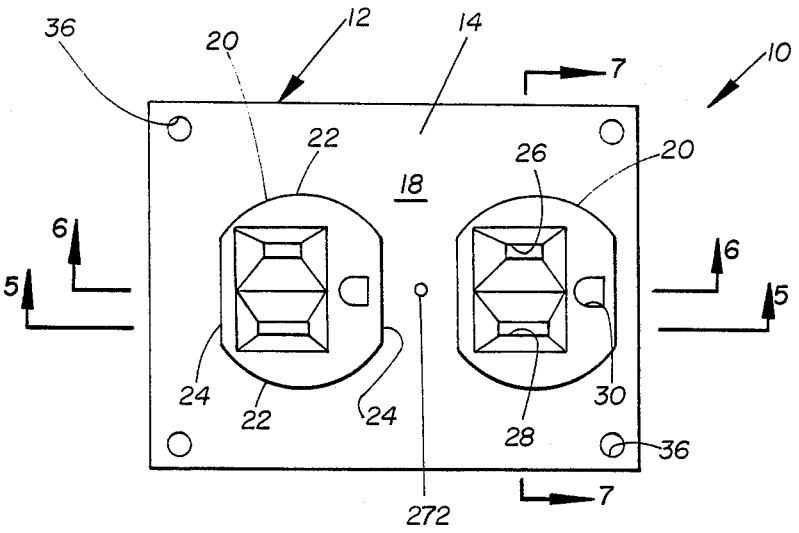
FIG. 1 shows a front view of the electrical receptacle apparatus of the present invention.
Figure 2:
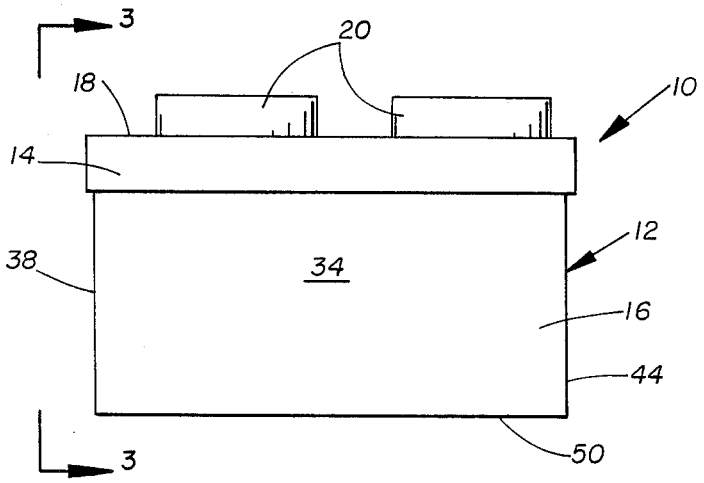
FIG. 2 is a side view of the apparatus.
Figure 3:
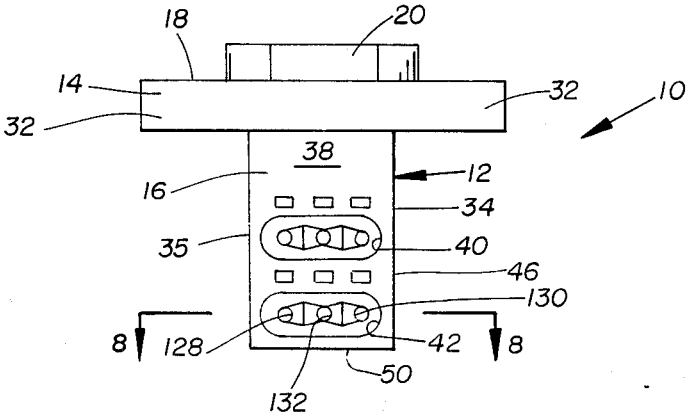
FIG. 3 is an end view as seen from line 3—3 in FIG. 2 and illustrating wire receiving housing openings therein.

Referring now to the drawings, more particularly, to FIGS. 1–3, the electrical receptacle apparatus of the present invention is shown and generally designated by the numeral 10. Apparatus 10 includes an insulating enclosure or housing 12 having first and second housing sections in the form of a cover 14 and a body 16.

The face of cover 14 includes a substantially planar portion 18 having a pair of protruding receptacle portions 20 extending outwardly therefrom.

Receptacle portions 20 are of the familiar doubly-truncated circular configuration having a pair of opposed curvilinear sides 22 and a pair of opposed parallel planar sides 24. Each receptacle portion 20 defines a plurality of openings therethrough including: a recessed, substantially rectilinear power opening 26; a recessed, substantially rectilinear common opening 28 having a length greater than that of power opening 26; and a ground or neutral opening. Those skilled in the art will see that each receptacle portion 20 is adapted for receiving either a two- or three-prong electrical plug, including polarized plugs, of a kind commonly used and well known in the art, as will be hereinafter described in more detail.

Planar portion 18 of cover 14 has flange portions 32 extending in opposite directions from sides 34 and 35 of body 16. Each flange portion 34 and 35 has at least one mounting hole 36 therethrough adjacent each corner, so that housing 12 may be easily mounted to a wall member, such as a stud. Typically, flange portion 32 will be on the outward edge of the stud, and side 34 or 35 of body 16 will be adjacent a side of the stud.

End 38 of body 16 has a pair of cable receiving external sockets 40 and 42, each of which is substantially identical in construction. As will be hereinafter discussed in more detail, each socket 40 and 42 is constructed for use with an electrical cable.

Figure 4:
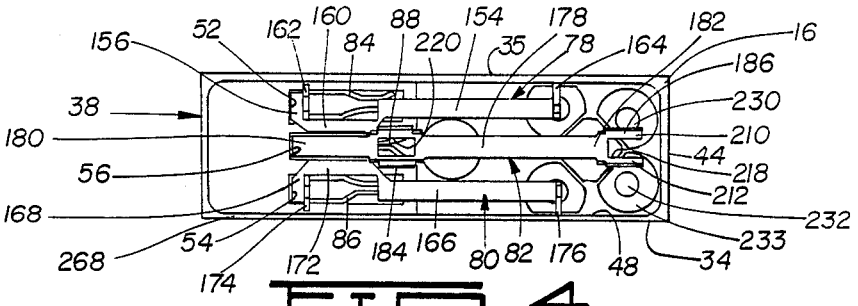
FIG. 4 is a front view of the electrical receptacle apparatus of the present invention with the cover portion of the housing removed.
Figure 5:
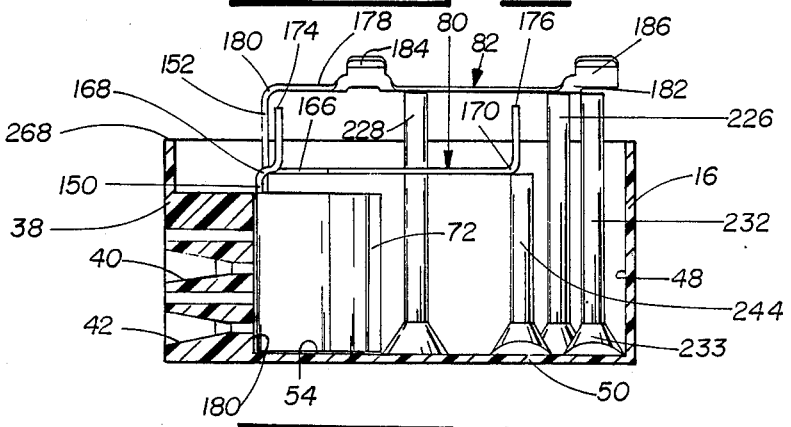
FIG. 5 is a longitudinal cross-section taken along line 5—5 in FIG. 1.
Figure 6:
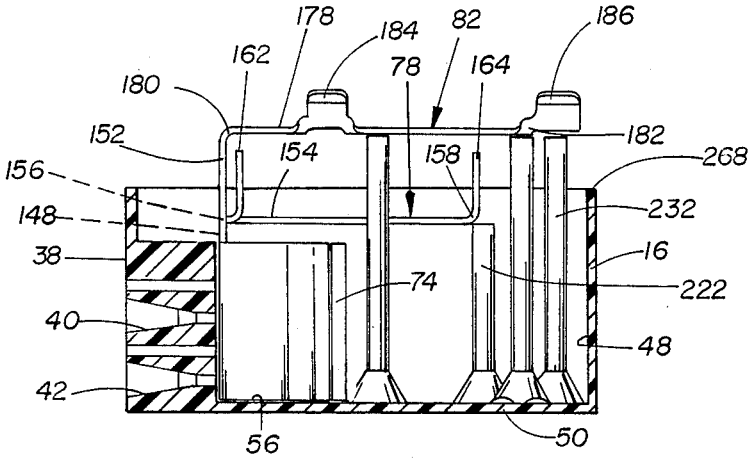
FIG. 6 is a longitudinal cross-section taken along line 6—6 in FIG. 1.

Referring now to FIGS. 4–6, details of body 16 are shown. In addition to end 38, body 16 has another end 44 opposite end 38. An internal cavity 48, opening outwardly toward cover 14, is defined in part by sides 34 and 35, end 44 and bottom wall 50. Extending longitudinally away from cavity 48, and toward end 38 are terminal receiving means, preferably characterized by a power terminal receiving cavity 52, a common terminal receiving cavity 54 spaced from receiving cavity 52 and a ground or neutral terminal receiving cavity 56 transversely positioned between cavities 52 and 54.

Figure 8:
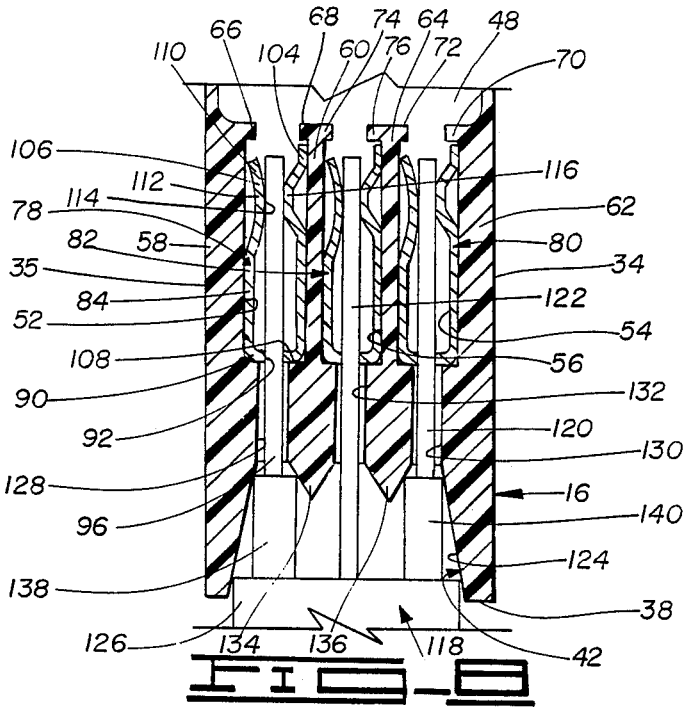
FIG. 8 is a fragmentary cross-sectional view taken along line 8—8 in FIG. 3.

Referring now also to FIG. 8, it will be seen that cavity 52 is bounded by an enlarged wall portion 58 of side 35 and an intermediate wall 60. Receiving cavity 54 is bounded by an enlarged wall portion 62 of side 34 and a second intermediate wall 64. Terminal receiving cavity 56 is bounded by intermediate walls 60 and 64. All three of cavities 52, 54 and 56 are also bounded by bottom wall 50 and open outwardly therefrom.

Receiving cavities 52, 54 and 56 open longitudinally into cavity 48. Adjacent this point of communication are a pair of inwardly extending shoulders 66 and 68 in cavity 52, shoulders 70 and 72 in cavity 54, and shoulders 74 and 76 in cavity 56.

Disposed in body 16 are electrical conducting means, preferably in the form of three electrical conducting contact strips or members including a power contact strip 78, a common contact strip 80, and a ground or neutral contact strip 82. Power contact strip 78 has a terminal portion 84 positioned in terminal receiving cavity 52. Common contact strip 80 includes a terminal portion 86 positioned in terminal receiving cavity 54. Similarly, ground contact strip 82 includes a terminal portion 88 disposed in terminal receiving cavity 56.

Figure 9:
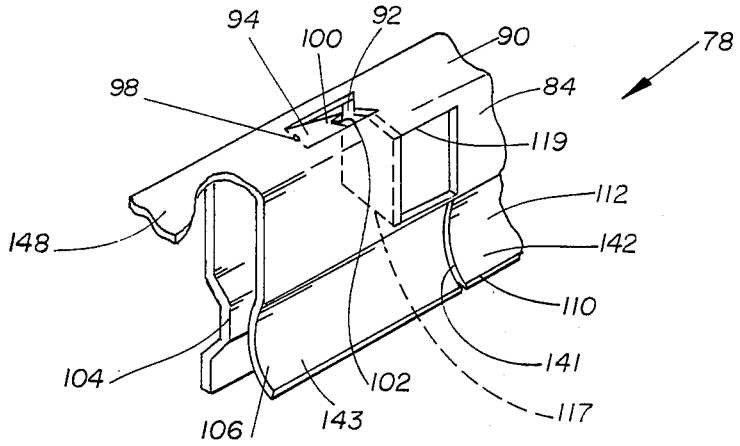
FIG. 9 is a partial isometric view of an electrical contact strip used in the apparatus.

Each of terminal portions 84, 86 and 88 are similarly constructed, and the general construction of any one of the terminal portions will be described with particular reference to terminal portion 84 of power contact strip 78. Terminal portion 84 has a first end facing toward end 38 of body 16 and thus toward sockets 40 and 42. The first end includes a middle elongated web portion 90 having wire receiving web openings 92 disposed therethrough. Referring also to FIG. 9, each web opening 92 is formed by punching a resilient tab 94 from web 90. Tab 94 may further be described as a wire retaining means for engaging and retaining a wire 96 inserted through web opening 92 and for resisting withdrawal of such a wire from the web opening as further described herein.

Each of resilient tabs 94 has a fixed end 98 and a free end 100. Free ends 100 are deflected away from web portion 90. Free ends 100 of resilient tabs 94 have notches 102 disposed therein. for engaging wire 96. Preferably, but not by way of limitation, notches 102 are V-notches as shown in FIG. 9.

Terminal portion 84 of power contact strip 78 further includes first and second elongated leg portions 104 and 106 extending away from web portion 90 toward shoulders 66 and 68 in receiving cavity 52. First and second leg portions 104 and 106 of each terminal portion are arranged to engagingly receive a wire, such as wire 96, therebetween.

Web portion 90 of terminal portion 84 of power contact strip 78 engages wall 108 which in part bounds receiving cavity 52 and is opposite shoulders 66 and 68. The end of first leg portion 104 opposite web portion 90 is adjacent shoulder 68.

Second leg portion 106 of terminal portion 84 of power contact strip 78, however, has a free end 110 which engages enlarged wall portion 58 of side 35 of body 16. Free end 110 is spaced from shoulder 66.

Second leg portion 106 is a flexible leg portion and is constructed so that it is flexed upon insertion of wire 96 between first and second leg portions 104 and 106. As second leg portion 106 is flexed upon insertion of a wire, such as wire 96, between leg portions 104 and 106, free end 110 thereof slides longitudinally along wall portion 58 toward shoulder 66.

A distal portion 112 of second leg portion 106 is arcuate in cross section and has a convex side 114 facing first leg portion 104. First leg portion 104 has a planar part 116 which is adjacent and offset toward arcuate portion 112 of second leg portion 106.

When wire 96 is inserted between first and second leg portions 104 and 106, it is engagingly gripped between convex side 114 of arcuate portion 112 of second leg portion 106 and planar part 116 of first leg portion 104.

As wire 96 is inserted between first and second leg portions 104 and 106, first leg portion 104 remains relatively fixed, since its lower end is adjacent shoulder 68, and the arcuate cross-sectional portion 112 of second leg portion 106 flexes by flattening the arc thereof. This causes second leg portion 106 to be resiliently biased against wire 96 so that it pushes against the wire and accordingly pushes the wire against planar part 116 of first leg portion 104.

Due to the flat large area of planar part 116, a large area of electrical contact is provided between wire 96 and first leg portion 104.

Referring again to FIG. 9, an alternate shoulder 117 is disposed between first and second leg portions 104 and 106 adjacent each web opening 92 and the corresponding tab 94. Shoulder 107 is preferably formed by punching the shoulder from the flat upper portion of second leg portion 106. In this way, a window 119 is formed in second leg portion 96. Window 119 has no function other than being the result of a formation of shoulder 117. Each shoulder 117 is spaced from, and generally faces, free end 100 of each tab 94 in all of the contact strips. As wire is inserted through web opening 92, shoulder 117 engages the wire and provides a means for an increased area of electrical contact between the wire and the contact strip compared to the first embodiment.

As shown in FIG. 3, and as already discussed herein, body 16 has a pair of cable receiving external sockets 40 and 42 therein. Both sockets 40 and 42 are shown in cross section in FIGS. 5 and 6, and socket 42 is also shown in cross section in FIG. 8.

Each of sockets 40 and 42 is constructed for use with a cable 118. Cable 118 is preferably a three-wire conductor having a power wire 96, already discussed, and further having a common wire 120 and a ground or neutral wire 122. The following description of socket 42 is applicable to both sockets.

Socket 42 is defined by a side wall 124 which is convergingly tapered toward the bottom of the socket. Tapered side wall 124 wedgingly engages outer casing 126 of cable 118. At the bottom of socket 42 are first and second aligned outer housing openings 128 and 130, along with a third aligned center opening 132, disposed therethrough. Openings 128, 130 and 132 are aligned with web openings 92 in web portions 90 of terminal portion 84 of power contact strip 78, terminal portion 86 of common contact strip 80, and terminal portion 88 of ground contact strip 82, respectively.

Socket 42 further includes first and second tapered mid-walls 134 and 136, respectively. The tapered walls in socket 42 are thus also adapted to receive an inner insulating sheath, such as sheath 138, which is shown wedgingly engaged with tapered midwall 134 and tapered side wall 124. Similarly, another insulating sheath 140 around common wire 120 is shown wedgingly engaged with tapered mid-wall 136 and side wall 124.

When cable 118 is inserted into socket 42, it is very snugly held therein through a combination of the already described resilient gripping action of terminal portions 84, 86 and 88, on power wire 96, common wire 120 and ground wire 122, respectively, in combination with the wedging action of casing 126 with tapered side wall 124, and the wedging action of inner sheaths 138 and 140 between tapered mid-walls 134 and 136, respectively, and tapered wall 124.

Referring again to FIG. 9, a transverse slot 141 is defined in second leg portion 106 of terminal portion 84. Slot 141 extends from free end 110 of second leg portion 106 and stops at approximately the opposite end of arcuate portion 112 thereof. Thus, arcuate portion 112 is divided into first and second sections 142 and 143, respectively. It will be seen that slot 141 is also longitudinally located between a pair of web openings 94 in web portion 90 of terminal portion 84. Thus, sections 142 and 143 of arcuate portion 112 of second leg portion 106 flex separately to compensate for varying thicknesses in wire size.

Referring again to FIGS. 3, 5 and 6, each housing opening 128, 130 and 132 has associated therewith a rectangular opening such as 144, 146 and 147, respectively. Rectangular openings 144, 146, and 147 extend through end 38 of body 16 and provide access for a tool to engage adjacent resilient tabs 94 near their fixed ends 98, so that the resilient tabs may be deflected away from corresponding web portions 90 to release the respective wires received through openings 128, 130 and 132.

Referring now again to FIGS. 4–6, further details of power contact strip 78, common contact strip 80 and ground contact strip 82 are shown.

Web portion 90 of terminal portion 84 of power contact strip 78 has an extended portion 148 extending in a direction opposite bottom wall 50. Web portion 90 of terminal portion 86 of common contact strip 80 has a similar extended portion 150. Web portion 90 of terminal portion 88 of ground contact strip 82 also has an extended portion 152 extending in a direction away from bottom wall 50. It will be seen that extended portion 152 of ground contact strip 82 is longer than extended portions 148 and 150 of power and common contact strips 78 and 80, respectively.

A cantilevered strip 154 extends from extended portion 148 of power contact strip 78 in substantially the same longitudinal direction as first and second leg portions 104 and 106 thereof. Cantilevered strip 154 includes a first, fixed end 156 attached to extended portion 148 and a second, free end 158 spaced from fixed end 156. Cantilevered strip 154 also includes an offset portion 160 adjacent fixed end 156 and offset toward ground contact strip 82. Plug receiving means are provided on cantilevered strip 154, and preferably, the plug receiving means are characterized by a pair of plug receiving portions 162 and 164 extending normally from cantilevered strip 154 in a direction substantially opposite that of extended portion 148. Plug receiving portions 162 and 164 are adapted for receiving a power prong of an electrical plug as will be hereinafter described.

Common contact strip 80 includes a longitudinally extending cantilevered strip 166 having a first, fixed end 168 attached to extended portion 150 and a second, free end 170. Cantilevered strip 166 is substantially parallel to, and coplanar with, cantilevered strip 154 and includes an offset portion 172 adjacent fixed end 168 and offset toward ground contact strip 82. Plug receiving means preferably in the form of plug receiving portions 174 and 176 which extend normally away from cantilevered strip 166 in a direction substantially opposite extended portion 150. It will be seen that common contact strip 80 is essentially a mirror image of power contact strip 78.

Ground contact strip 82 also includes a longitudinally extending cantilevered strip 178 which is substantially parallel to cantilevered strips 154 and 166 in a longitudinal direction. Cantilevered strip 178 has a first, fixed end 180 attached to extended portion 152 and a second, free end 182 spaced from the fixed end. Cantilevered strip 178 of ground contact strip 182 also includes plug receiving means, preferably in the form of a pair of plug receiving portions 184 and 186, thereon.

Plug receiving portions 162, 164, 174 and 176 are substantially identical. Plug receiving portions 164 and 176 are best shown in the cross section of FIG. 7, and the following description of plug receiving portion 164 also is applicable to each of plug receiving portions 162, 174 and 176.

Plug receiving portion 164 on cantilevered strip 154 includes a base portion 188 with spaced first and second finger portions 190 and 192 extending therefrom. Finger portions 190 and 192 define a gap therebetween having a partially circular portion 194 and a slot portion 196. At the outer end of slot 196 first and second leg portions 190 and 192 have chamfers 198 and 200 thereon, respectively, for facilitating insertion of a prong therebetween.

It will be seen that slot 196 between first and second finger portions 190 and 192 is in registry with a corresponding power opening 26 in receptacle 20 in cover 14. Aligned power opening 26 and slot 196 thus are adapted for receiving a power prong 202 of a typical electrical plug 204. Power prong 202 will be in sliding engagement with power opening 26, but first and second leg portions 190 and 192 of plug receiving portion 164 are flexible portions adapted to grip the power prong and provide good electrical contact therewith.

Plug 204 also includes a common prong 206 received in common slot 28 in receptacle 20 which in turn is in registry with plug receiving portion 176.

Figure 7:
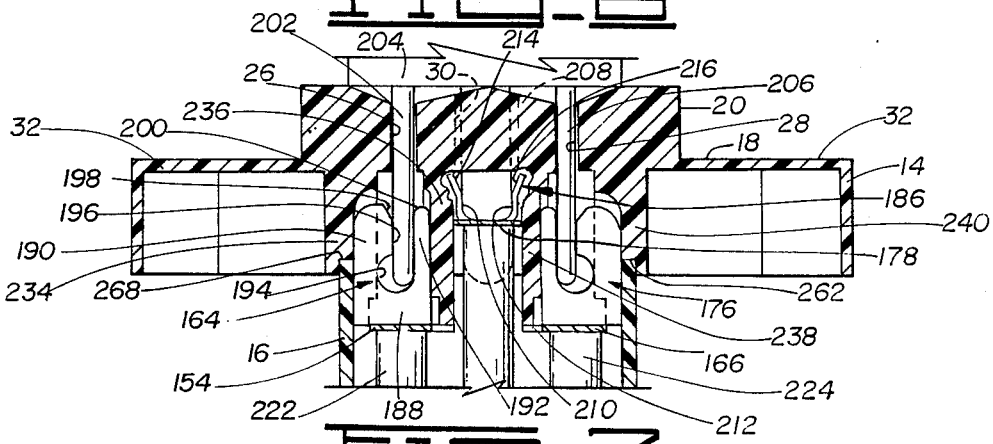
FIG. 7 illustrates a transverse cross-sectional view taken along line 7—7 in FIG. 1.

If electrical plug 204 is of the three-prong grounded type, it will also include a ground or neutral prong 208. Unlike substantially planar power and common prongs 202 and 206, ground prong 208 is of substantially circular cross section, and is adapted for being slidingly received in ground opening 30 of receptacle 20. Because of this difference in ground prong 208, ground plug receiving portions 184 and 186 are of totally different construction from plug receiving portions 162, 164, 174 and 176. However, plug receiving portions 184 and 186 are nearly identical, and the following description of ground plug receiving portion 186, as best seen in FIG. 7, also is applicable to ground plug receiving portion 184.

Plug receiving portion 186 includes a first flexible finger portion 210 and a second flexible finger portion 212 which is essentially a mirror image of the first finger portion. An angled portion 214 angles outwardly at the upper end of first finger portion 121, and a similar angled portion 216 extends outwardly from the upper end of second finger portion 212. Angled portions 214 and 216 facilitate insertion of ground prong 208. Referring also to FIG. 4, it will be seen that first and second finger portions 210 form a part of free end 182 of cantilevered strip 178, and the first and second finger portions define an open-ended aperture 218 therebetween. When common prong 208 of plug 204 is inserted through common opening 30 of receptacle 20, ground prong 208 will be grippingly received between first and second finger portions 210 and 212 and will pass through aperture 218. First and second finger portions 210 and 212 are flexed apart as ground prong 208 is inserted therebetween, and thus resiliently grip the prong and provide good electrical communication therewith.

Plug receiving portion 184 is positioned between fixed end 180 and free end 182 of cantilevered strip 178 and an enclosed aperture 220 is defined between the first and second finger portions of plug receiving portion 184. Thus, plug receiving portion 184 is also adapted for receiving a ground prong 208 of a plug 204.

Supporting means are provided for supporting cantilevered strips 154, 166 and 178 so that the cantilevered strips will not be deflected toward body 16 when a plug 204 is plugged into a receptacle 20. Preferably, the supporting means comprises a plurality of posts in internal cavity 48 of body 16 and extending toward the open side thereof. Positioned adjacent and supporting free end 158 of cantilevered strip 154 of power contact strip 78 is a post 222, and a similar post 224 is adjacent and supports free end 170 of cantilevered strip 166 of common contact strip 80. A longer post 226 is adjacent free end 182 of cantilevered strip 178 of ground contact strip 182, and post 226 is spaced away from aperture 218 in plug receiving portion 186. Another post 228 supports an intermediate portion of cantilevered strip 178, and post 228 is spaced from aperture 220 in plug receiving portion 184.

Two other posts 230 and 232 are adjacent end 44 of body 16 and support post 226. Posts 230 and 232 provide support for cover 14 when it is positioned in place on body 16. Posts 230 and 232 do not provide support for any cantilevered strip portions of the electrical contact strips. All of the above-described posts preferably have a substantially conical base adjacent bottom 50 of body 16, such as base 233 for post 232.

Figure 10:
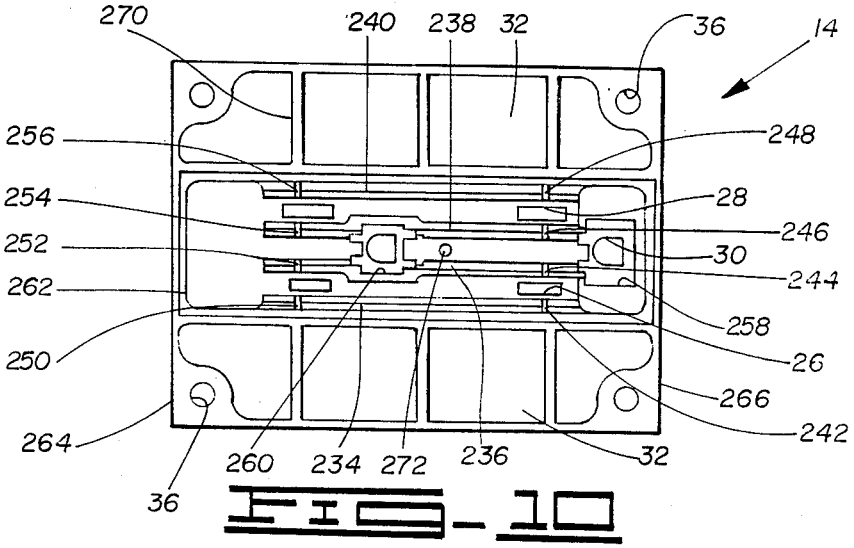
FIG. 10 shows a rear view of the cover of the housing.

Referring now to FIGS. 7 and 10, cantilevered strips 154, 166 and 178 of power contact strip 78, common contact strip 80 and ground contact strip 82, respectively, are separated and supported by a plurality of substantially longitudinal insulating walls or partitions 234, 236, 238 and 240 which extend from cover 14 toward body 16. Walls 234, 236, 238 and 240 are integrally formed with cover 14. Wall 234 defines a slot 242 therein for receiving first finger portion 190 of plug receiving portion 164 of power contact strip 78, and wall 236 defines a similar slot 244 therein for receiving second finger portion 192 of plug receiving portion 164. It will seen that slots 242 and 244 straddle power opening 26 in cover 14. Slots 242 and 244 longitudinally and transversely align and support plug receiving portion 164 when apparatus 10 is assembled. Similar slots 246 and 248 are formed in walls 238 and 240, respectively, for receiving, aligning and supporting plug receiving portion 176 of common contact strip 80. Slots 250 and 252 in walls 234 and 236, respectively, receive, align and support plug receiving portion 162 of power contact strip 78, and slots 254 and 256 in walls 238 and 240, respectively, receive, align and support plug receiving portion 174 of common contact strip 80.

Enlarged, recessed cavities 258 and 260 are provided in cover 14 for receiving, aligning and supporting plug receiving portions 186 and 184, respectively, of ground contact strip 82.

A substantially rectilinear annular groove 262 is formed in walls 234 and 240, and along transverse ends 264 and 266 in cover 14. Groove 262 is adapted for receiving upper lip 268 of body 16. Thus, cover 14 fits snugly against body 16 to form insulating enclosure or housing 12. Cover 14 and body 16 can be joined by any manner known in the art, such as cementing.

Also seen in FIG. 10 are a plurality of transverse ribs 270 which support flange portions 32 of cover 14.

When electrical receptacle apparatus 10 is totally assembled, it will be seen that the apparatus provides an electrical receptacle for receiving typical two- and three-prong electrical plugs, including polarized plugs in which the common prong is larger than the power prong. Also, the electrical wiring to the apparatus is easily installed without the need for terminal screws. When properly installed, the wallboard used in the wall structure will be substantially flush with planar surface 18 of cover 14, and a hole 272 is provided in cover 14 for receiving a screw used in mounting a standard receptacle cover plate (not shown) of a kind known in the art.

It can be seen, therefore, that the electrical receptacle apparatus of the present invention is well adapted to carry out the ends and advantages mentioned, as well as those inherent therein. While a presently preferred embodiment of the invention has been illustrated for the purposes of this disclosure, numerous changes in the arrangement and construction of parts may be made by those skilled in the art, which changes are encompassed within the scope and spirit of the present invention as defined by the appended claims.

What is claimed is:

1. An electrical receptacle apparatus comprising:

an insulating housing defining a plug receiving opening therein; and an electrical contact member disposed in said housing and comprising:

wire receiving means for receiving an electrical wire;

a cantilevered strip extending from said wire receiving means and longitudinally with respect to said housing; and plug receiving means on said cantilevered strip for receiving an electrical plug portion.

2. The apparatus of claim 1 wherein said housing includes first and second housing sections constructed to be joined together for enclosing said electrical contact strip.

3. The apparatus of claim 1 further comprising supporting means for supporting said cantilevered strip at least when said electrical plug portion is received by said plug receiving means.

4. The apparatus of claim 3 wherein said supporting means is characterized by a post in said housing and adjacent a free end of said cantilevered strip.

5. The apparatus of claim 1 wherein said housing comprises mounting means for mounting to a wall member.

6. The apparatus of claim 5 wherein said mounting means is characterized by a flange extending from said housing.

7. The apparatus of claim 1 wherein said wire engaging means comprises:

a web portion having a wire receiving web opening disposed therethrough; and first and second leg portions extending from said web portion, said leg portions being arranged for engagingly receiving said wire therebetween.

8. The apparatus of claim 7 wherein:

said web portion is an elongated web portion, and said web opening is one of a plurality of aligned web openings disposed through said elongated web portion;

each of said leg portions is an elongated leg portion; and at least one of said first and second leg portions is split transversely to a length thereof between adjacent web openings, so that said leg portions can engagingly receive different sizes of wire in said adjacent web openings.

9. The apparatus of claim 7 wherein:

said housing defines a wire receiving housing opening therein; and said housing opening is aligned with said wire receiving web opening.

10. The apparatus of claim 7 wherein at least a part of one of said first and second leg portions is arcuate in cross section with a convex side thereof facing the other of said leg portions.

11. The apparatus of claim 10 wherein the other of said first and second leg portions has a planar part adjacent and offset towards said part of said one leg portion, so that said wire is engagingly gripped between said convex side of said arcuate part of said one leg portion and said planar part of said other leg portion with said one leg portion resiliently biased against said wire.

12. The apparatus of claim 7 wherein said wire receiving means further comprises retaining means for engaging said wire when said wire is inserted through said wire receiving web opening and for resisting withdrawal of said wire from said opening.

13. The apparatus of claim 12 wherein said retaining means of said web portion of said electrical contact strip is a resilient tab punched from said web portion, said tab having a fixed end integrally attached to said web portion and having a free end extending from said web portion away from said housing.

14. The apparatus of claim 13 wherein said free end of said tab has a notch therein for engaging said wire.

15. The apparatus of claim 7 further comprising shoulder means disposed between said leg portions and adjacent said wire receiving web opening for engaging said wire and providing electrical contact therewith.

16. The apparatus of claim 15 wherein said shoulder means is characterized by a shoulder stamped from one of said first and second leg portions.

17. The apparatus of claim 16 wherein said shoulder extends substantially perpendicular to said web portion.

18. An electrical receptacle apparatus comprising:

an insulating enclosure defining a plurality of terminal cavities therein with at least one wire receiving enclosure opening in communication with each of said terminal cavities; and a plurality of electrical conducting members, each member comprising:

a middle web portion disposed in a terminal cavity having a plurality of wire receiving web openings disposed therethrough, each web opening being in registry with a corresponding wire receiving enclosure opening, said web portion further including retaining means for engaging a wire inserted through said enclosure opening and said web opening for resisting withdrawal of said wire from said web opening;

first and second leg portions disposed in said terminal cavity and extending from said web portion, said first and second leg portions being arranged for engagingly receiving said wire therebetween; and plug receiving means for receiving and engaging a prong of an electrical plug and for resisting withdrawal of said prong therefrom.

19. The apparatus of claim 18 wherein said plurality of electrical conducting members comprises:

an electrical conducting power member;

an electrical conducting common member; and an electrical conducting ground member.

20. The apparatus of claim 18 wherein at least one of said first and second leg portions is split transversely to a length thereof between adjacent web openings, so that said leg portions can engagingly receive different sizes of wire in said adjacent web openings.

21. The apparatus of claim 18 wherein at least a part of one of said first and second leg portions is arcuate in cross section with a convex side thereof facing the other of said leg portions.

22. The apparatus of claim 21 wherein the other of said first and second leg portions has a planar part adjacent and offset toward said arcuate part of said one leg portion, so that said wires are engagingly gripped between said convex side of said arcuate part of said one leg portion and said planar part of said other leg portion with said one leg portion resiliently biased against said wire.

23. The apparatus of claim 18 wherein said retaining means of said web portion comprises a resilient tab punched from said web portion, said tab having a fixed end integrally attached to said web portion and having a free end extending from said web portion.

24. The apparatus of claim 23 wherein said free end of said tab has a notch therein for engaging said wire.

25. The apparatus of claim 18 wherein:

each of said electrical conducting members further comprises a cantilevered strip extending from said web portion and having a fixed end integrally formed with said web portion and a free end spaced from said fixed end; and said plug receiving means comprises a set of first and second spaced finger portions extending from said cantilevered strip, said finger portions being adapted for engagingly receiving said prong therebetween.

26. The apparatus of claim 25 wherein said enclosure further defines a pluraltiy of plug receiving openings therein, each plug receiving opening being in registry with a set of first and second finger portions.

27. The apparatus of claim 25 wherein said set of first and second finger portions is one of a plurality of sets of first and second fingers portions on a cantilevered strip, said sets of said first and second finger portions being longitudinally spaced along said cantilevered strip.

28. The apparatus of claim 25 wherein said cantilevered strip is substantially perpendicular to said web portion.

29. The apparatus of claim 25 further comprising support means for supporting said cantilevered strip when said set of first and second finger portions are engaged by said prong.

30. The apparatus of claim 29 wherein said supporting means comprises a post disposed in said enclosure and attached thereto, said post extending substantially perpendicular to said cantilevered strip.

31. The apparatus of claim 18 further comprising shoulder means disposed between said leg portions and adjacent said retaining means for engaging said wire and providing electrical contact therewith.

32. The apparatus of claim 31 wherein said shoulder means is characterized by a shoulder stamped from one of said first and second leg portions.

33. The apparatus of claim 32 wherein said shoulder extends substantially perpendicular to said middle web portion.

34. An electrical receptacle comprising:

a body defining a plurality of terminal receiving cavities therein, said body having a wall defining a plurality of wire receiving body openings therethrough in communication with said terminal receiving cavities;

a cover positionable adjacent said body and defining a plurality of plug receiving cover openings therein and including a plurality of partitions thereon extending toward said body; and a plurality of electrical conducting members disposed in said body and enclosed by said body and said cover, each electrical conducting member comprising:

a terminal portion disposed in one of said body terminal receiving cavities and comprising:

a web portion substantially parallel to said body wall and having a plurality of aligned wire receiving web openings therethrough in registry with corresponding wire receiving body openings; and first and second leg portions extending from said web portions and away from said body wall, said leg portions being arranged for engagingly receiving a wire inserted through a body opening and a corresponding web opening;

an elongated strip having a first end attached to said web portion and a second end spaced from said first end, said strip extending normally from said web portion and away from said body wall, each of said strips being substantially parallel to the other of said strips and disposed such that said partitions on said cover extend between adjacent strips; and a plurality of sets of first and second finger portions extending from said strip and away from said body, each of said sets of first and second finger portions being in registry with a corresponding plug receiving cover opening, said finger portions further being arranged for engagingly receiving a prong of an electrical plug inserted through a corresponding cover opening.

35. The receptacle of claim 34 wherein said body further comprises a plurality of supporting members for supporting at least said second ends of said strips.

36. The receptacle of claim 34 wherein said cover further includes a flange portion extending from said body and adapted for attachment to a wall member.

37. The receptacle of claim 34 wherein said terminal portion of said electrical conducting member further comprises a shoulder disposed between said leg portions and adjacent said wire receiving web opening for engaging said wire and providing electrical contact therewith.

38. The receptacle of claim 37 wherein said shoulder is stamped from one of said first and second leg portions and extends substantially perpendicular to said web portion.

* * * * *